US006425737B1

(12) United States Patent
Hatanaka

(10) Patent No.: US 6,425,737 B1
(45) **Date of Patent: *Jul. 30, 2002**

(54) TURBINE

(76) Inventor: Takefumi Hatanaka, No. 1-5-4, Jindaiji, Mitakasi, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/633,537

(22) Filed: Aug. 7, 2000

(30) Foreign Application Priority Data

Oct. 1, 1999 (JP) ..... 11-315734
Feb. 7, 2000 (JP) ..... 2000-067699

(51) Int. Cl.[7] ..... F04D 11/00
(52) U.S. Cl. ..... 415/199.2; 415/203; 415/208.4
(58) Field of Search ..... 415/101, 199.1, 415/199.2, 203, 208.3, 208.4, 209.1

(56) References Cited

U.S. PATENT DOCUMENTS 5,443,362 A * 8/1995 Crites et al. ..... 415/184
6,202,782 B1 * 3/2001 Hatanaka ..... 180/301

* cited by examiner

*Primary Examiner*—Edward K. Look
*Assistant Examiner*—Richard Edgar
(74) *Attorney, Agent, or Firm*—Jordan and Hamburg LLP

(57) ABSTRACT

A turbine comprises a housing having an inlet and an outlet, a stator mounted in the housing and including an arcuate stator blade projecting radially inward, and a turbine rotor having a central annular jet path accommodating therein said arcuate stator blade in communication with the inlet and the outlet. The turbine rotor comprises a pair of annular flywheel discs formed with pluralities of rotor blades facing each other in an axial direction. The arcuate stator blade has at least one deflection guide to direct the jet stream of working fluid toward the rotor blades in the central annular jet path.

6 Claims, 4 Drawing Sheets

TURBINE

BACKGROUND OF THE INVENTION

1. Field of the Invention

This invention relates to turbines and, more particularly, to turbines for use in water turbines, steam turbines and gas turbines.

2. Description of the Related Art

U.S. Pat. Nos. 5,385,446 and 5,624,235 disclose steam turbines in which working fluid flows in an axial direction through multi-staged stator blades and turbine blades. In these turbines, there are spacings between an inner wall of a turbine housing and outer peripheries of the turbine blades, and unused working fluid escapes through those spacings without impinging upon the turbine blades. Thus, the turbine becomes low in efficiency, large in size and high in manufacturing costs U.S. Pat. No. 5,071,312 discloses a turbine having a rotor which is a disc with blades priojecting axially from its face working with rotor blades on a disc-like stator. In this turbine, the rotor blades have their rear surfaces impinging upon the radially flowing working fluid and, thus, a reaction torque is applied to the rotor so that its output power is reduced. Therefore, it is difficult to improve the operating efficiency of the above turbine.

JP-81,502 discloses a turbine having a rotor with its outer periphery formed with an annular partition wall to define a peripheral passage. In this turbine, the peripheral passage incorporates therein a plurality of circumferentially spaced blades which intersect the flow of the working fluid at right angles. When the working fluid impinges upon the blades during rotation of the rotor, turbulent flows are created in the peripheral passage, and the working fluid can not smoothly flow through the peripheral passage. When the rotor speed increases, a strong fluid reaction wall in unity with the rotor blades is created in the peripheral passage thereby increasing a back pressure, and the turbine operates at an extremely lowered efficiency. Further, rotor blades are weak in strength and, therefore, the turbine becomes large in size, thereby increasing the manufacturing costs.

SUMMARY OF THE INVENTION

It is therefore an object of the present invention to provide a turbine which can overcome the shortcomings encountered in the prior art.

It is another object of the present invention to provide a turbine which has a high operating efficiency, compact in structure, small in size and low in manufacturing costs.

DESCRIPTION OF THE PREFERRED EMBODIMENTS

Figure 1:
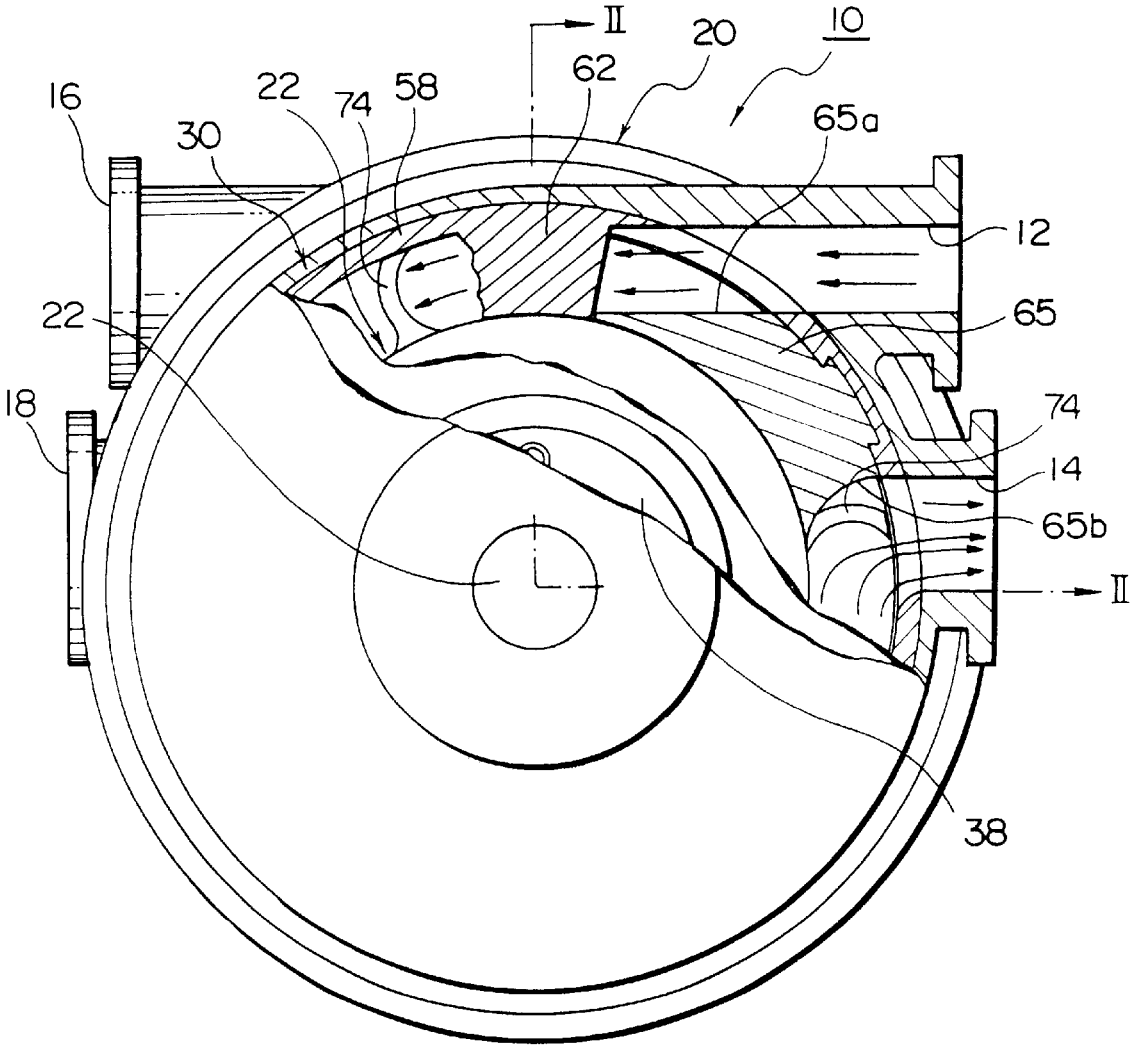
FIG. 1 is a plan view, partly in cross section, of a turbine according to the present invention.
Figure 2:
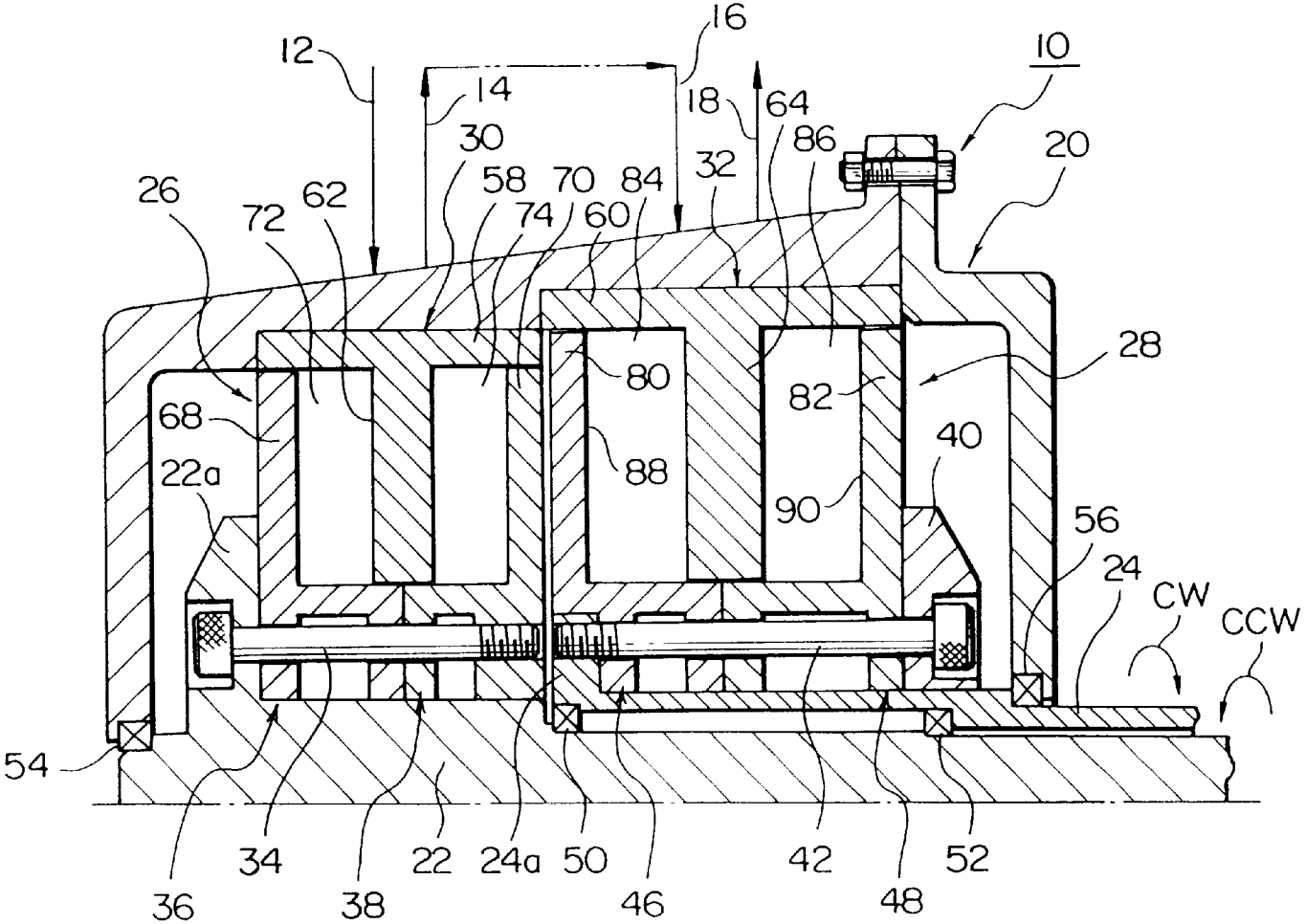
FIG. 2 is a cross sectional view taken on line II—II of FIG.

A preferred embodiment of a turbine according to the present invention will now be described in detail hereinafter with reference to the drawings. In FIGS. 1 and 2, the turbine

10 comprises a housing 20 having first and second inlets 12, 16 tangentially extending to the housing 20, and first and second outlets 14, 18. The first and second inlets 12, 16 are arranged to introduce first and second jet streams of working fluid into the housing 20 in opposite directions, viz., in counter-clockwise and clockwise directions, respectively. The first and second outlets. 14, 18 exhaust expanded fluids therefrom. As shown in FIG. 2, the outlet 14 of a front stage may be connected to the inlet of a rear stage of the turbine 10 and the expanded fluid is exhausted through the outlet 18.

The turbine 10 further comprises first and second turbine rotors 26, 28 rigidly supported by first and second output shafts 22, 24, respectively, and the first and second stators 30, 32. The first output shaft 22 has a flange 22*a* by which rotor discs 36, 38 are rigidly supported by means of a bolt 34. Similarly, the output shaft 24 has a flange 24*a* by which rotor discs 46, 48 are rigidly supported by means of a flange 40 and a bolt 42. The second output shaft 24 is composed of a sleeve through which the first output shaft 22 concentrically extends and rotatably supported by bearings 50, 52 mounted in the sleeve of output shaft 24. The first output shaft 22 has its left end supported by a bearing 54, while the second output shaft 24 is rotatably supported by a bearing 56. The first and second stators 30, 32 comprise first and second annular stator rings, respectively, which have first and second arcuate statorblades 62, 64 which extend radially inward from central portions of the stator rings 58, 60. As seen in FIG. 1, the housing 20 has a partition member 65 disposed between the inlet 12 and the outlet 14, with guide surfaces 65*a* and 65*b*, respectively, being in alignment with the inlet 12 and the outlet 14. Likewise, the housing 20 also incorporates another partition member (not shown) arranged between the inlet 16 and the outlet 18.

The first and second rotor discs 36, 38 comprise first and second annular flywheel discs 68, 70 which face each other. The flywheel discs 68, 70 have axially indented first and second pluralities of arc-shaped rotor blades 72, 74, respectively, between which the central jet path 66 is defined. The rotor blades 72, 74 have radially extending valve surfaces 72*a*, 74*a*, respectively and pressure chambers 76, 78, respectively.

The first and second rotor discs 36, 38 comprise first and second annular flywheel discs 68, 70 which faces each other. The flywheel discs 68, 70 have axially indented first and second pluralities of arc-shaped rotor blades 72, 74, respectively, between which the central jet path 66 is defined. The rotor blades 72, 74 have radially extending valve surfaces 72*a*, 74*a*, respectively and pressure chambers 76, 78, respectively.

Figure 3:
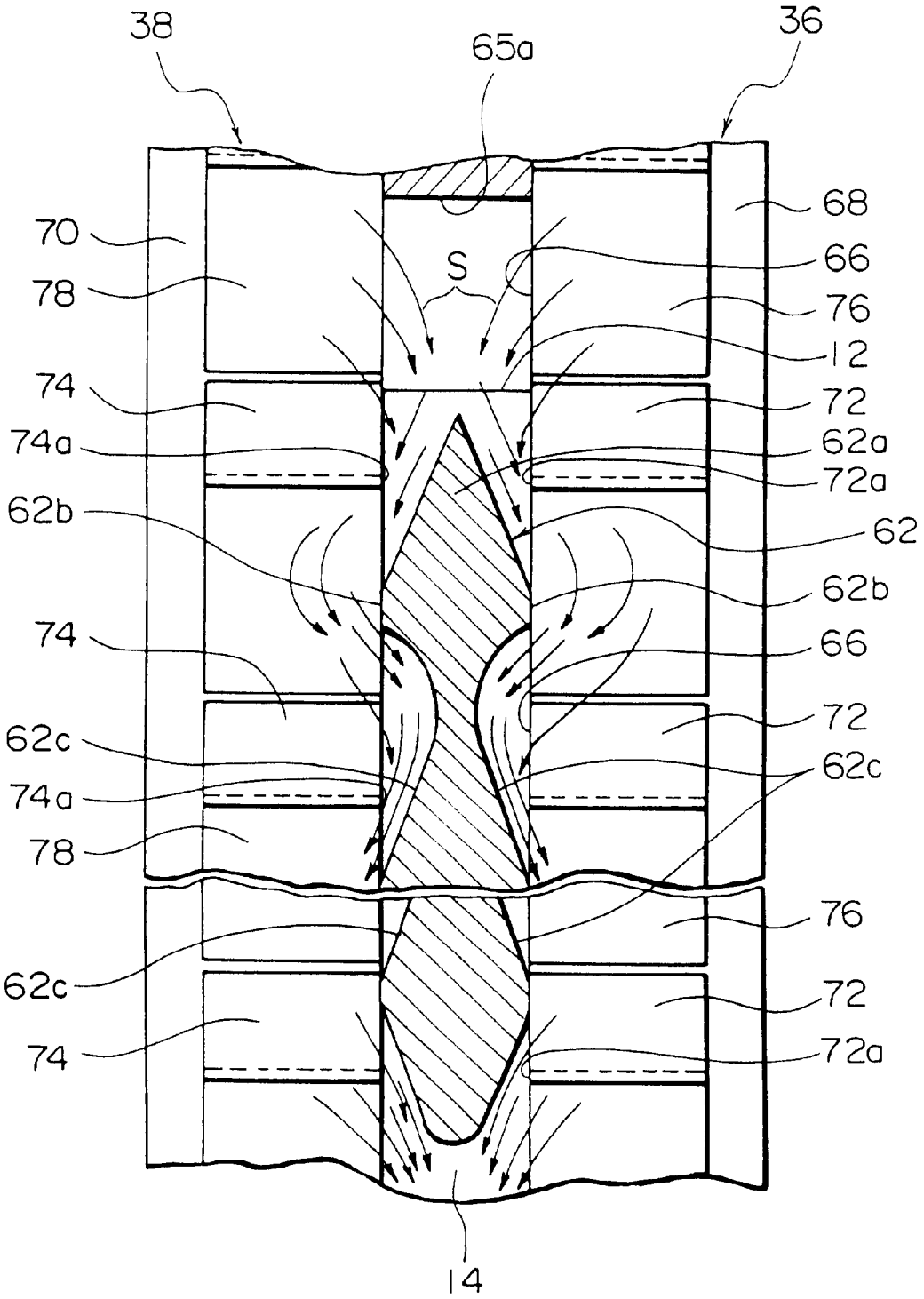
FIG. 3 is a schematic view showing the relationship between the turbine rotor and the stator shown in FIGS. 1 and 2.

As shown in FIG. 2, the stator blade 64 has the same structure as the stator blade 62 shown in FIG. 3, and the second turbine rotor 28 comprises rotor discs 46, 48 having annular flywheel discs 80, 82, respectively, and spaced from each other. The flywheel discs 80, 82 have first and second groups of rotor blades 84, 86, respectively, and an annular jet path formed therebetween. The rotor blades 84, 86 are arranged to have their working surfaces directed toward the inlet 16 so that the second turbine rotor 28 rotates to drive the output shaft 24 in a clockwise direction CW in FIG. 2, while the first turbine rotor 26 drives the output shaft 22 in a counterclockwise direction CCW in FIG. 2.

Figure 4:
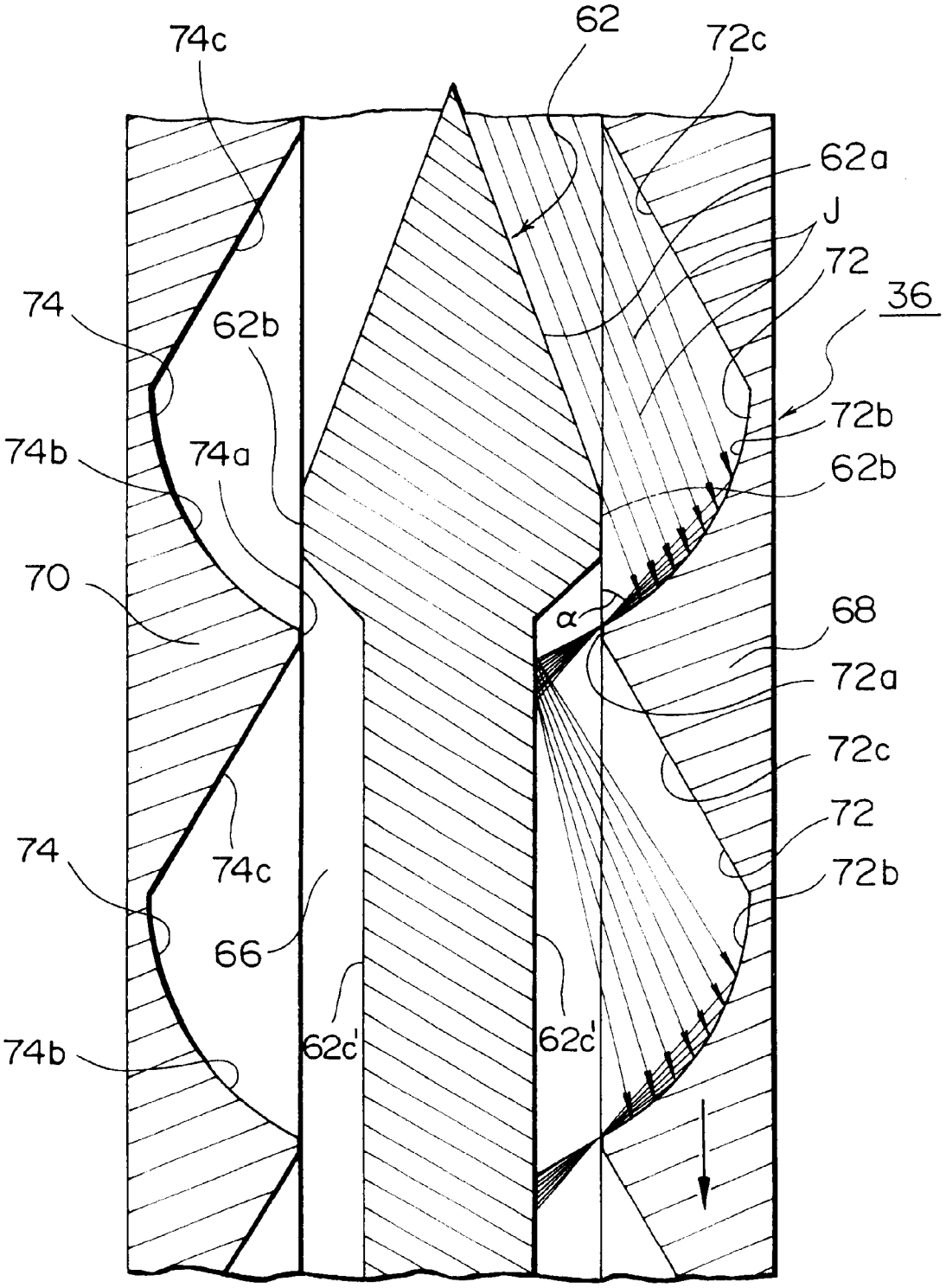
FIG. 4 is a schematic view showing a modified form of the turbine rotor and the stator.

FIG. 4 shows a modification of the stator and the turbine rotor of FIG. 3, with the same parts bearing the same reference numerals as those used in FIG. 3 except that a single apostrophe is added to each of the reference numerals of modified parts. In FIG. 4, an auxiliary deflection guide

62*c*' has straight guide surfaces continuous to the blade shutter walls 62*b*. The annular flywheel discs 68, 70 have axially indented rotor blades 72, 74, respectively, which have leading arcuate working surfaces 72*b*, 74*b*, respectively, which intersect the annular jet path 66 at acute angle $\alpha$, and trailing surfaces 72*c*, 74*c*, respectively. The jet streams J are guided by the main guide 62 to impinge upon the arcuate working surfaces 72*b*, 74*b* from which the jet streams emit and impinge upon the auxiliary guide 62*c*' to be deflected to the second stage rotor blades 72, 74.

With the structure discussed above, while the turbine has been shown and described as comprising two stage type, the turbine of the present invention may comprise a single stage or multi-stage structure with a single output shaft. Also, independent jet streams of working fuid may be supplied to respective inlets of a multi-stage turbine.

What is claimed is:

1. A turbine comprising:

a housing having an inlet to introduce a jet stream of a working fluid, and an outlet to exhaust an expanded fluid;

a stator mounted in said housing and having an annular stator ring fixed therein, and an arcuate stator blade radially projecting inward from said stator ring;

a turbine rotor rotatably disposed in said stator for expanding said working fluid to drive an output shaft and including first and second annular flywheel discs having first and second pluralities of rotor blades, respectively, which face each other in an axial direction, and a central annular jet path formed between the first and second pluralities of rotor blades, said annular jet path communicating with said inlet and said outlet to allow said jet stream to pass therethrough and accommodating said arcuate stator blade to deflect said jet stream toward said rotor blades.

2. A turbine according to claim 1, in which said arcuate stator blade includes a main deflection guide located in close proximity to said inlet and an auxiliary deflection guide formed downstream of said main deflection guide in said annular jet path.

3. A turbine according to claim 2, in which said arcuate stator blade further includes first and second blade shutter walls formed downstream of said main deflection guide to periodically shut off the flow of said jet stream through said annular jet path.

4. A turbine according to claim 1 or 2, in which each of said rotor blades has an arc-shaped working surface.

5. A turbine according to claim 1 or 2, in which each of said rotor blades has a leading working surface axially indented in each of said annular discs, and a trailing guide surface continuous with said leading working surface to guide said jet stream to said working surface.

6. A turbine comprising:

a housing having first and second tangential inlets to introduce first and second jet streams of working fluid in first and second directions, respectively, and first and second outlets to exhaust first and second expanded fluids;

first and second stators mounted in said housing in concentric relation and including first and second annular stator rings, and first and second arcuate stator blades radially projecting inward therefrom;

first and second turbine rotors rotatable in said first and second directions, respectively, in said first and second stators, respectively, said first and second turbine rotors being fixedly supported by solid and sleeve output shafts, respectively, with said solid output shaft extending through and rotatably supported by said sleeve output shaft, said first and second turbine rotors including first and second pairs of annular flywheel discs each formed with a plurality of rotor blades and a central annular jet path to accommodate each of said first and second arcuate stator blades and communicating with each of said first and second inlets and each of said outlets; and said first and second arcuate stator blades including first and second deflection guides to deflect said first and said second jet streams toward said first and second turbine rotors in said first and second directions, respectively, to drive said solid and sleeve output shafts in said first and second directions.

* * * * *